US005450725A

United States Patent [19]

Takahara et al.

[11] Patent Number: 5,450,725

[45] Date of Patent: Sep. 19, 1995

[54] GAS TURBINE COMBUSTOR INCLUDING A DIFFUSION NOZZLE ASSEMBLY WITH A DOUBLE CYLINDRICAL STRUCTURE

[75] Inventors: Takeshi Takahara, Yokohama; Tadashi Kobayashi, Chigasaki; Masao Itoh, Yokohama, all of Japan

[73] Assignee: Kabushiki Kaisha Toshiba, Kawasaki, Japan

[21] Appl. No.: 266,591

[22] Filed: Jun. 28, 1994

[30] Foreign Application Priority Data

Jun. 28, 1993 [JP] Japan ..... 5-157472

[51] Int. Cl.[6] ..... F23R 3/30

[52] U.S. Cl. ..... 60/737; 60/742

[58] Field of Search ..... 60/737, 748, 742, 733, 60/746, 747

[56] References Cited

U.S. PATENT DOCUMENTS

| | | | |
|---|---|---|---|
| 4,498,288 | 2/1985 | Vogt | 60/39.06 |
| 4,982,570 | 1/1991 | Waslo et al. | 60/737 |
| 5,069,029 | 12/1991 | Kuroda et al. | 60/737 |
| 5,127,229 | 7/1992 | Ishibashi et al. | 60/747 |
| 5,193,346 | 3/1993 | Kuwata et al. | 60/742 |
| 5,323,614 | 6/1994 | Tsukahara et al. | 60/737 |

FOREIGN PATENT DOCUMENTS 4-43726 10/1992 Japan .

*Primary Examiner*—Timothy S. Thorpe
*Attorney, Agent, or Firm*—Foley & Lardner

[57] ABSTRACT

A gas turbine combustor comprises a cylindrical outer casing having one end closed by a header plate. A combustor liner provided with an inner combustion chamber which is divided into a first-stage combustion region on a side of the header plate and a second-stage combustion region formed on a downstream side of the first-stage combustion region. A first-stage fuel supply unit mounted to the header plate for injecting a first-stage fuel to the first-stage combustion region and a second-stage fuel supply unit mounted to the header plate for injecting a second-stage fuel previously mixed in a lean fuel state. The first-stage fuel supply unit includes a first-stage fuel nozzle assembly, which supplies the first-stage fuel, formed by combining a diffusion combustion nozzle and a pre-mixture combustion nozzle. The pre-mixture combustion nozzle has, at an intermediate portion thereof, a pre-mixing portion for preliminarily mixing the first-stage fuel with an air, and the pre-mixing portion having a diameter in a downstream portion thereof smaller than that of an upstream portion thereof so as to form a pre-mixed flow into a contraction flow. The pre-mixing fuel nozzle of the first stage fuel nozzle assembly is disposed so as to surround the diffusion combustion nozzle disposed in a central portion thereof.

9 Claims, 7 Drawing Sheets

GAS TURBINE COMBUSTOR INCLUDING A DIFFUSION NOZZLE ASSEMBLY WITH A DOUBLE CYLINDRICAL STRUCTURE

BACKGROUND OF THE INVENTION

The present invention relates to a gas turbine combustor in which air and fuel are preliminarily mixed with each other. Particularly, the gas turbine combustor is capable of lowering the concentration of NOx contained in a gas exhausted from a gas turbine.

A gas turbine plant and a combined cycle power plant each includes a plurality of gas turbine combustors. A combustion gas burnt in the gas turbine combustors is guided to gas turbines so as to drive the gas turbines. It has been known that the heat efficiency of the turbine of a gas turbine plant of the described type is improved when the temperature of the inlet portion of the turbine is raised. In order to improve the heat efficiency of the turbine, it is necessary to raise the temperature of the inlet portion of the turbine.

In the gas turbine combustor, the temperature of the combustion gas is variously limited due to the heat resisting limit of the gas turbine and the material of the combustor. Furthermore, the necessity of taking a countermeasure against NOx (nitrogen oxides) in the gas turbine combustor causes the temperature of the combustion gas to be limited.

A main cause of generation of NOx in the gas turbine combustor is a local rise of the temperature of the combustion gas in the gas turbine combustor. The quantity of generated NOx depends on the temperature of the combustion gas in a combustion region in the gas turbine combustor. NOx is generated in a large quantity in a case where fuel and air are brought to a diffusion combustion at a high temperature near an adiabatic flame temperature in a state of an equivalent ratio of about 1 of fuel and air.

As a method of preventing the generation of NOx in the gas turbine combustor, a lean pre-mixture combustion method is available in which fuel and air are previously mixed with each other and burnt in a lean fuel state.

A gas turbine combustor employing the lean pre-mixture combustion method has been disclosed, for example, in Japanese Utility Model Publication No. HEI 4-43762. The gas turbine combustor, as shown in FIG. 6, has an arrangement in which a pilot fuel is, in addition to the previous mixture of the main fuel, mixed to reduce the diffusion combustion generating NOx in a large quantity to reduce NOx significantly.

The conventional gas turbine combustor shown in FIG. 6 has a combustor liner 1 divided into a first-stage combustion region 2 and a second-stage combustion region 3. A pilot fuel nozzle 4 is disposed in the head portion of the combustor liner 1, the fuel nozzle 4 supplies pilot fuel A to the first-stage combustion region 2.

A pre-mixing duct 6 for previously mixing main fuel C injected with air through the main fuel nozzle 5 is disposed around the combustor liner 1. The main fuel C mixed previously in the pre-mixing duct 6 is injected into the second-stage combustion region 3 to be burnt.

On the other hand, the pilot fuel nozzle 4 has, in the central portion thereof, a fuel passage portion 4*a* extending in the axial direction of the pilot fuel nozzle 4. An air passage portion 4*b* is disposed to surround the fuel passage portion 4*a*. At the inlet port and an outlet port (the inlet port for the liner) of the air passage portion 4*b*, swirlers 7 and 8 for swirling air flows are disposed. According to the structure in an arrangement in which the pilot fuel A is injected into each of the swirlers 7 and 8 or the swirler downstream portion.

As shown in FIG. 7, the operation of the conventional gas turbine combustor is performed in a manner such that a combustion operation using only pilot fuel A injected through the pilot fuel nozzle 4 is performed from ignition to a state in which the gas turbine load becomes somewhat partial load. At this time, the flow rate of the pilot fuel is controlled by one fuel control valve 9 and the pilot fuel is supplied to the pilot fuel nozzle 4. The pilot fuel nozzle 4 divides the pilot fuel into pilot diffusion fuel a and pilot pre-mixed fuel b.

The pilot diffusion fuel a is diffused by the swirler 8 and supplied to the first-stage combustion region 2 to be burnt. On the other hand, the pilot pre-mixed fuel b is, in the air passage portion 4*b*, uniformly mixed with air to be injected into the first-stage combustion region 2 through the swirler 8 to be subjected to combustion.

At this time, the fuel distribution of the pilot diffusion fuel a and the pilot pre-mixed fuel b is determined by the area of each of the fuel injection ports. In order to reduce NOx, the passage area of each of the swirlers 7 and 8 and the air passage portion 4*b* is made to be relatively large in order to sufficiently lower the fuel-air ratio (weight flow rate of fuel/weight flow rate of air).

When the operation of the gas turbine in a heavy load region has started, the fuel control valve 9 is throttled to decrease the pilot fuel A so as to lower the diffusion combustion ratio as shown in FIG. 7. Furthermore, a fuel control valve 10 is opened to supply the main fuel C to the main fuel nozzle 5. The supplied main fuel C is uniformly mixed in the pre-mixing duct 6, and then, it is injected into the combustor liner 1 to be burnt in the second-stage combustion region 3. In the pre-mixing duct 6, a passage area is maintained through which air capable of sufficiently previously lean-mixing the main fuel, which occupies 70 to 80% of the overall fuel rate, flows.

Since a portion of the pilot fuel A is, in the conventional gas turbine combustor, previously lean-mixed in addition to the main fuel, the ratio of the pilot diffusion fuel a can be lowered. As a result, NOx can significantly be reduced. However, the ratio of the diffusion fuel a is determined by the flow rate of the pilot fuel A and, therefore, the lowering thereof is limited to about 20% of the overall flow rate. The ratio cannot be further lowered and accordingly a limitation is present to further reduce NOx.

Another example of a conventional gas turbine combustor has been disclosed, for example, in Japanese Patent Laid-Open Publication No. HEI 4-98014. An example of the gas turbine combustor of this example is shown in FIGS. 8 and 9. The gas turbine combustor has a basic structure substantially the same as that the gas turbine combustor shown in FIG. 6, in which a combustion chamber formed in the combustor liner 1 is divided into a first-stage combustion region 2 and a second-stage combustion region 3 formed downstream side thereof. A plurality of pre-mixing ducts or pre-mixing pipes 6 are disposed around the combustor liner 1, the pre-mixing ducts 6 previously uniformly mixing main fuel and air in a lean fuel state, followed by injecting the main fuel previously mixed into the second-stage combustion region 3 to burn the main fuel.

The gas turbine combustor shown in FIG. 8 has a pilot fuel nozzle 4 composed of only a diffusion fuel nozzle so that pilot fuel A injected through the pilot fuel nozzle 4 is formed into a swirling flow by a pilot combustion swirler 8. The swirling flow is guided by an annular swirling flow guide 11 disposed downstream the pilot fuel nozzle 4 so that a stable combustion in the first-stage combustion region 2 formed at the central position of the swirling flow guide 11 is realized.

Since also the stable combustion can be also achieved in a state where the quantity of the pilot fuel A is relatively small at the pilot diffusion combustion, the diffusion combustion performed by the pilot fuel nozzle 4 is decreased and the pre-mixing combustion can be performed by the main fuel nozzle 5 with substantially preventing generation of NOx so as to realize significant reduction of NOx.

On the other hand, the gas turbine combustor shown in FIG. 9 comprises the pilot fuel nozzle 4 of the gas turbine combustor shown in FIG. 8 which is partially formed into a pre-mixing structure to decrease the NOx.

The described gas turbine combustor has a pilot pre-mixed fuel nozzle 7, additionally disposed upstream from the pilot combustion swirler 8, that gives a swirling flow to the pilot fuel A injected through the pilot fuel nozzle 4. Since the pilot pre-mixed fuel nozzle 7 injects the pilot pre-mixed fuel b followed by mixing it in the air passage portion 12 in a lean fuel state and burning the pre-mixture in the first-stage combustion region 2, the generation of NOx can be reduced. At this time, the pilot diffusion fuel a is decreased as compared with that in the gas turbine combustor shown in FIG. 8, thus realizing the reduction of NOx.

In recent gas turbine plants, the temperature of the combustion gas in the gas turbine combustor is raised to further improve the heat efficiency of the gas turbine. With the trend of raising the high temperature of the combustion gas, it is further required to reduce NOx. In order to realize an aimed value of reducing NOx, development of a low-NOx gas turbine combustor is desired in which the diffusion combustion, which generates NOx in a large quantity, is restricted to several % of the overall combustion quantity and the residual portion is fully burnt in a pre-mixed and lean state with generation of NOx substantially prevented.

The conventional gas turbine combustor shown in FIG. 6 has the structure designed in order to sufficiently cause the pilot pre-mixed fuel b to be a lean fuel mixed state in which air in a relatively large quantity is allowed to flow through the pilot pre-mixed fuel nozzle 7 and the air passage portion 4*b*. Therefore, the pilot combustion swirler 8 is enlarged relatively in size, and therefore the total size cannot easily be reduced. Accordingly, the reduction of the pilot diffusion fuel a to about several % of the overall flow rate of the fuel provides a problem of instable combustion, such as incomplete combustion or misfire. It therefore becomes impossible to perform an operation in which the pilot diffusion combustion is changed from about 30% to about several % of the overall fuel flow rate with a pressure difference through the fuel injection port maintained by one pilot fuel nozzle 4.

Furthermore, the gas turbine combustor shown in FIG. 9 has a problem caused from a similar problem that the pilot diffusion fuel a cannot be reduced to about several % of the overall quantity of the fuel.

The gas turbine combustor shown in FIG. 8 has the structure in which the pilot fuel nozzle 4 is composed of only the diffusion fuel nozzle. Therefore, an operation with only the pilot diffusion combustion which generates NOx considerably is performed until the gas turbine load reaches a load with which the pre-mixture combustion with the fuel C can be commenced.

The operation with only the pilot diffusion combustion is designed to maintain the diffusion combustion by introducing, in a relatively large quantity, air required for the diffusion combustion through the pilot combustion swirler 8. Accordingly, in the gas turbine combustor shown in FIG. 8, the ratio of the pilot diffusion fuel cannot be lowered in a heavy gas turbine load region in which the main fuel C is introduced and the pre-mixed combustion that generates NOx in a small quantity is commenced. If such ratio is lowered to about several %, the instable combustion, such as the incomplete combustion or the misfire, cannot be prevented.

Furthermore, the conventional gas turbine combustor is not provided with a specific air passage portion and a flame holding mechanism for performing the pilot diffusion combustion which is several % of the overall fuel flow rate, thus being defective and inconvenient.

SUMMARY OF THE INVENTION

A primary object of the present invention is to substantially eliminate the defects or drawbacks encountered in the prior art described above and to provide a gas turbine combustor capable of lowering generation of NOx by significantly reducing the ratio of diffusion combustion which generates NOx and capable of maintaining stable combustion even if the ratio of diffusion combustion be reduced.

Another object of the present invention is to provide a gas turbine combustor intended to significantly lower NOx by restricting the ratio of diffusion combustion to several % or less of the total fuel flow rate and capable of surely achieving the stable combustion by reducing the size of a diffusion combustion nozzle.

A further object of the present invention is to provide a gas turbine combustor capable of realizing the stable combustion of pre-mixed fuel gas, preventing misfire and thus significantly lowering NOx by causing a pre-mixed flow guided in a pre-mixture combustion nozzle of a first-stage fuel nozzle to be a contraction flow.

A still further object of the present invention is to provide a gas turbine combustor capable of performing further stable combustion by forming a fuel passage portion to be formed in a diffusion combustion nozzle of a first-stage fuel nozzle into a first fuel passage portion and a second fuel passage portion which are independent from each other and by forming fuel injection ports adaptable to each fuel flow rate.

A still further object of the present invention is to provide a gas turbine combustor capable of significantly lowering NOx by further uniformly mixing pre-mixed fuel and air in a pre-mixing portion formed in a pre-mixture combustion nozzle of a first-stage combustion nozzle.

These and other objects of the present invention can be achieved by providing a gas turbine combustor which comprises:

- a cylindrical outer casing having one end opening closed by a header plate;
- a combustor liner disposed inside the outer casing and provided with an inner combustion chamber which is divided into a first-stage combustion region on a side of the header plate and a second-stage combustion region formed on a downstream side of the first-stage combustion region;

a first-stage fuel supply means mounted to the header plate for injecting a first-stage fuel to the first-stage combustion region; and a second-stage fuel supply means mounted to the header plate for injecting a second-stage fuel previously mixed in a lean fuel state, wherein the first-stage fuel supply means comprises a first-stage fuel nozzle assembly which supplies the first-stage fuel and which is formed by combining a diffusion combustion nozzle and a pre-mixture combustion nozzle, the pre-mixture combustion nozzle having, at an intermediate portion thereof, a pre-mixing portion for preliminarily mixing the first-stage fuel with an air and the pre-mixing portion having a diameter in a downstream portion thereof smaller than that of an upstream portion thereof so as to form a pre-mixed flow into a contraction flow.

In the preferred or more detailed embodiments, the first-stage fuel nozzle assembly is a pilot fuel nozzle assembly and the second-stage fuel supply means is disposed outside the pilot fuel nozzle assembly, the second-stage fuel supply means including a plurality of second-stage fuel nozzle assemblies, the pilot nozzle assembly and the second-stage fuel nozzle assemblies being mounted to the header plate closing one end opening of the outer casing.

The pre-mixing fuel nozzle of the first stage fuel nozzle assembly is disposed so as to surround the diffusion combustion nozzle disposed in a central portion thereof. The diffusion combustion nozzle of the first-stage fuel nozzle assembly has a double cylindrical structure having a fuel passage portion extending in an axial direction at a central portion thereof and an air passage portion formed in an outer peripheral portion of the fuel passage portion, the air passage portion being provided, on the first-stage combustion region side, with a swirler means for imparting a swirling motion to an air and fuel injection port for injecting a fuel from the fuel passage portion. The fuel passage portion formed in the diffusion combustion nozzle is provided with a first fuel passage portion capable of supplying the first-stage fuel in a large quantity and a second fuel passage portion capable of supplying the first-stage fuel in a small quantity which is about several % of a total fuel flow rate, which are formed independently from each other.

The pre-mixture combustion nozzle of the first-stage fuel nozzle assembly has an annular air passage portion surrounding the diffusion combustion nozzle, and the air passage portion has a swirler means for imparting a swirling motion to an air disposed on an inlet side of the combustion liner and a pre-mixing portion formed at an intermediate portion thereof for previously mixing air and fuel. The pre-mixture combustion nozzle of the first-stage fuel nozzle assembly is provided with a fuel injection port for injecting fuel into the annular air passage portion at at least either one portion on upstream side and downstream side of the swirler means. The fuel injection port of the pre-mixture combustion nozzle is formed in each of a plurality of projection portions formed to the annular air passage portion so as to radially project therein, and the fuel injection port of the pre-mixture combustion nozzle is formed to each of the projection portions.

According to the structures and features of the present invention described above, the fuel is injected into the first-stage combustion region in the combustor liner by the first-stage fuel supply means. On the other hand, the fuel is, by the second-stage fuel supply means, injected in a lean fuel state into the second-stage combustion region to be burnt in the combustor liner. On the other hand, the first-stage fuel supply means has the first-stage fuel nozzle formed by combining the diffusion combustion nozzle and the pre-mixture combustion nozzle. The diffusion combustion nozzle realizes the diffusion combustion exhibiting excellent combustion efficiency and combustion stability. In order to substantially prevent generation of NOx in the pre-mixture combustion nozzle, the diameter of the downstream portion of the pre-mixing portion for previously mixing in a lean fuel state is made to be smaller than that of the upstream portion of the same so that the stable combustion of the pre-mixed gas and the prevention of misfire are realized. Thus, the stable combustion can be maintained in a state where the ratio of diffusion combustion which generates NOx considerably is very low. As a result, NOx can be significantly reduced and stable combustion can be maintained even if the ratio of the diffusion combustion be lowered.

The diffusion combustion nozzle of the first-stage fuel nozzle provided for the gas turbine combustor has the fuel passage portion in the central portion thereof and the air passage portion formed concentrically around the passage portion and allowing an air flow rate adaptable to the diffused fuel which is several % of the total fuel flow rate to flow. The swirler for swirling air and the fuel injection port are provided on the inlet port side of the combustor liner of the air passage portion. As a result, the diffusion combustion exhibiting excellent combustion efficiency and combustion stability can be realized.

In the described state, the diffusion combustion nozzle has the fuel passage portion individually sectioned into the first fuel passage portion and the second fuel passage portion. Therefore, the first fuel passage portion can be formed into a fuel passage for allowing a relatively large quantity of diffusion combustion fuel to flow at the light turbine load, while the second fuel passage portion can be formed into a fuel passage for allowing the diffusion combustion fuel which is several % of the total fuel flow rate to flow at the low NOx operation under heavy gas turbine load. By forming the fuel injection port having an opened area adaptable to each fuel flow rate in the downstream portion of each fuel passage portion, the further stable combustion can be achieved and the lowering of NOx can be realized. Since the air passage portion of the diffusion combustion nozzle may have a passage area corresponding to the diffused fuel which is several % of the total fuel flow rate, its size can be reduced. The small-size diffusion combustion nozzle surely enables the stable combustion to be realized.

The pre-mixture combustion nozzle of the first-stage fuel supply means has the fuel injection portion formed into a radial direction projection shape with respect to the annular air passage portion. Further, a plurality of fuel injection ports are formed at the axial directional positions of the projection to inject the fuel in a dispersed manner. As a result, further uniform mixture can be achieved and thus lowering of NOx can be realized.

DESCRIPTION OF THE PREFERRED EMBODIMENT

Figure 1:
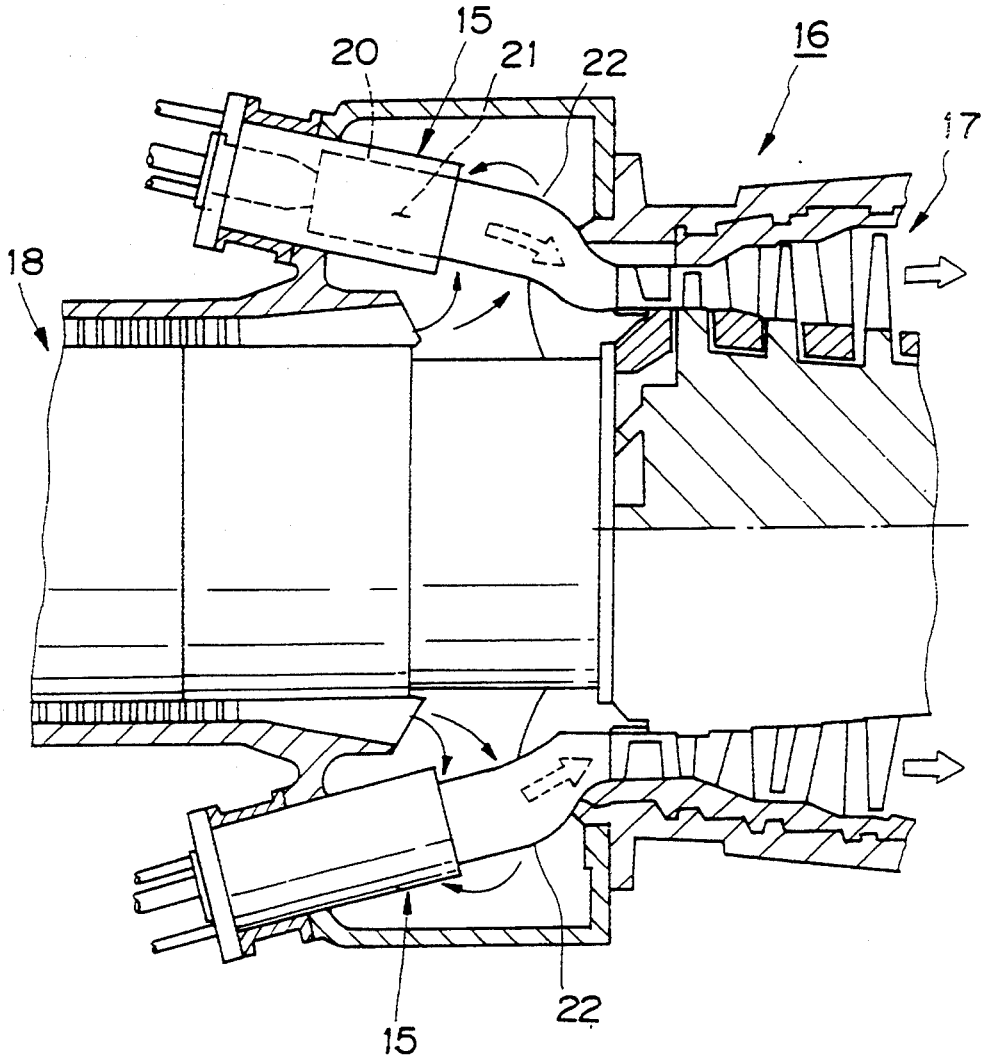
FIG. 1 is a schematic sectional view showing an example of a portion gas turbine plant to which a gas turbine combustor according to the present invention is applied.

FIG. 1 is a schematic view showing a portion of a gas turbine plant employing a gas turbine combustor 15 according to one embodiment of the present invention. An illustrated example of the gas turbine plant 16 comprises a compressor 18 disposed coaxially with the gas turbine 17. The gas turbine plant 16 performs an operation such that the compressed air discharged by the operation of the compressor 18 is guided into a gas turbine combustor 15 and then is burnt with fuel in a combustion chamber 21 formed in a combustor liner 20, and the burnt gas is guided to a gas turbine 17 through a transition piece 22, thus the gas turbine 17 being operated. Thus, a generator, not shown, connected to the gas turbine 17 is rotated and operated.

Figure 2:
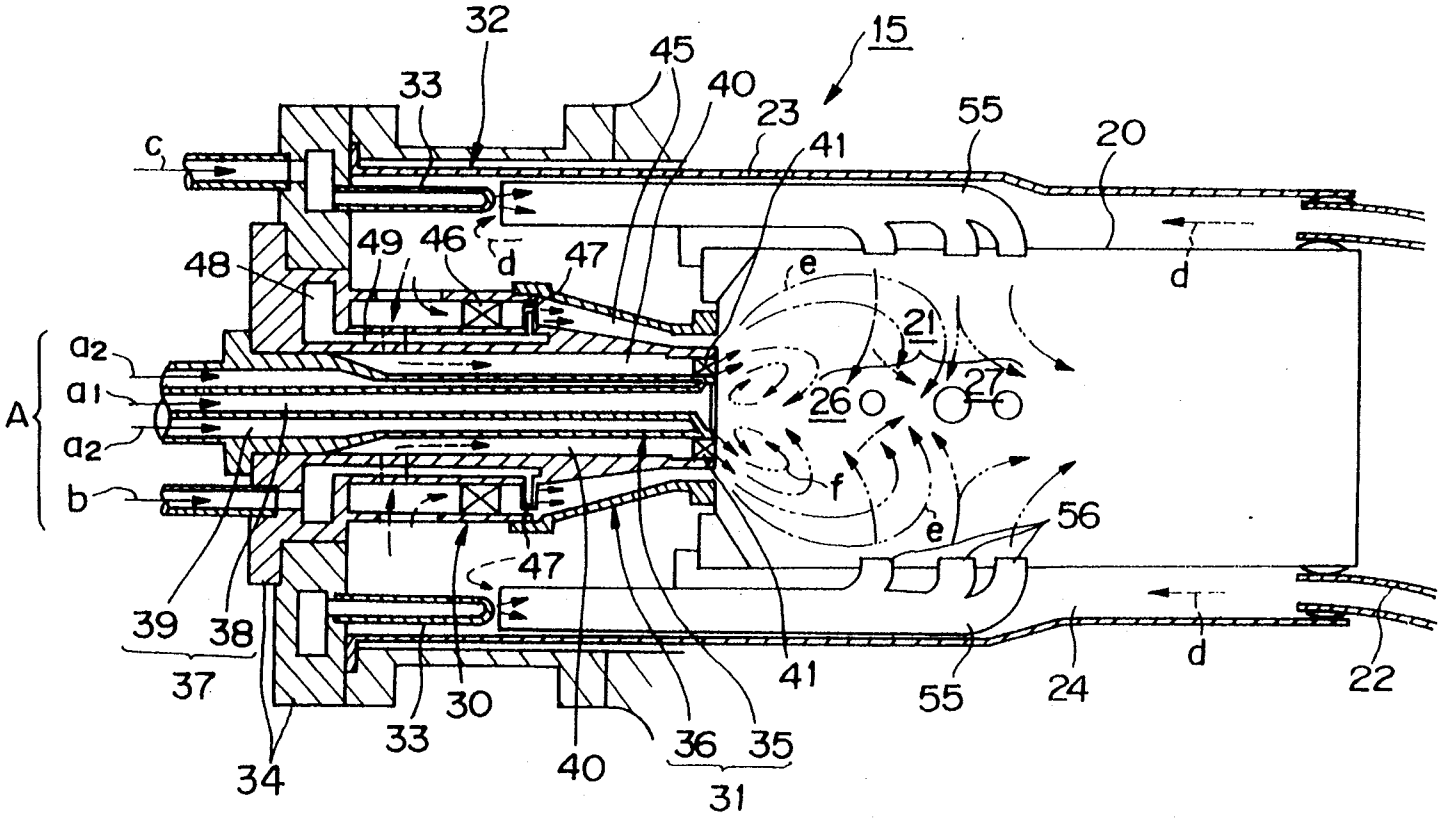
FIG. 2 is a longitudinal sectional view showing an embodiment of the gas turbine combustor according to the present invention.

A plurality of the gas turbine combustors 15 are disposed in a circumferential direction at an intermediate position between the compressor 18 and the gas turbine. Each of the gas turbine combustor 15, as shown in FIG. 2, has an arrangement in which the combustor liner 20 is, as an inner cylinder, accommodated in a combustor outer cylinder 23. A combustion chamber 21 is formed in the combustor liner 20 and an annular, sleeve-shape, passage 24 for compressed air is formed between the outer cylinder 23 and the inner cylinder 20. Air discharged from the compressor 18 is guided through the air passage 24.

The combustion chamber 21 formed in the combustor liner 20 is sectioned into a first-stage combustion region 26 formed in the head portion, upstream side, of the combustor liner 20 and a second-stage combustion region 27 formed downstream side of the first combustion region 26.

In the head portion of the combustor liner 20, a first-stage fuel supply means 30 for injecting pilot fuel serving as first-stage fuel into the first-stage combustion region 26 is disposed. The first-stage fuel supply means 30 has a pilot fuel nozzle 31 disposed to serve as a first-stage fuel nozzle for supplying pilot fuel A to the first-stage combustion region 26. On the outside of the pilot fuel nozzle 31, a second-stage fuel supply means 32 for supplying main fuel serving as second-stage-fuel into the second-stage combustion region 27 is disposed. The second-stage fuel supply means 32 has a main fuel nozzle 33 serving as a plurality of second-stage fuel nozzles disposed on the outside of the pilot fuel nozzle 31. The pilot fuel nozzle 31 and the main fuel nozzle 33 are provided for a head plate 34 covering an opening formed in the combustor outer cylinder 23.

The pilot fuel nozzle 31 is composed of a pilot diffusion combustion nozzle 35 disposed in a central portion and a pilot pre-mixing nozzle 36 disposed in the periphery thereof so as to inject fuel into the first-stage combustion region 26 in the combustor liner 20.

A fuel passage portion 37 of the pilot diffusion combustion nozzle 35 is formed into a concentric double-cylinder shape having a first pilot diffusion fuel passage portion 38 disposed in the central portion thereof to guide first pilot diffusion fuel a1 and a second pilot diffusion fuel passage portion 39 disposed to surround the first passage portion 38 to allow second pilot diffusion fuel a2 to flow.

The pilot diffusion combustion nozzle 35 further comprises an annular, sleeve-shape, pilot diffusion combustion air passage portion 40 formed to surround the second pilot diffusion fuel passage portion 39. The air passage portion 40 is formed into a passage structure which permits air flow rate suitable for the diffused fuel of about several %, for example, 2% to 4%, of the overall flow rate of the fuel to flow. In the leading portion of the pilot diffusion combustion air passage portion 40, adjacent the inlet portion of the combustor liner 20, a pilot diffusion combustion swirler 41 and first and second pilot diffusion fuel injection ports 43 and 44 respectively independent from each other are disposed. The first pilot diffusion fuel injection port 43 and the second injection port 44 are opened between swirling blades, not shown, of the pilot diffusion combustion swirler 41. A plurality of, for example, twelve swirling blades are disposed in the circumferential direction at the outlet portion of the pilot diffusion combustion air passage portion 40.

On the other hand, the pilot pre-mixing nozzle 36 of the pilot fuel nozzle 31 is structured to surround the pilot diffusion combustion nozzle 35. The pilot pre-mixing nozzle 36 has a pilot pre-mixture combustion air passage portion 45 formed concentrically on the outside of the pilot diffusion combustion air passage portion 40. The air passage portion 45 is formed into an annular, sleeve-shape, passage. In the inlet port portion of the pilot pre-mixture combustion air passage portion 45, a pilot pre-mixture combustion swirler 46 is disposed. At a position downstream (or upstream) the swirler 46 of the annular air passage portion 45, a pilot pre-mixture combustion nozzle 47 is formed to radially project. The pilot pre-mixed fuel b is supplied to the pilot pre-mixture combustion nozzle 47 from a pre-mixture fuel passage 49 through the pilot pre-mixture header 48.

The air passage 45 of the pilot pre-mixing nozzle 36 has a pre-mixing portion formed at an intermediate portion thereof (downstream side of the swirler 46) and arranged to mix air and the pilot pre-mixed fuel with each other. The pre-mixing portion is structured to have a diameter reduced from the upstream portion toward the downstream inlet port portion of the combustor liner to form a pre-mixed flow into a contraction flow.

Figure 3:
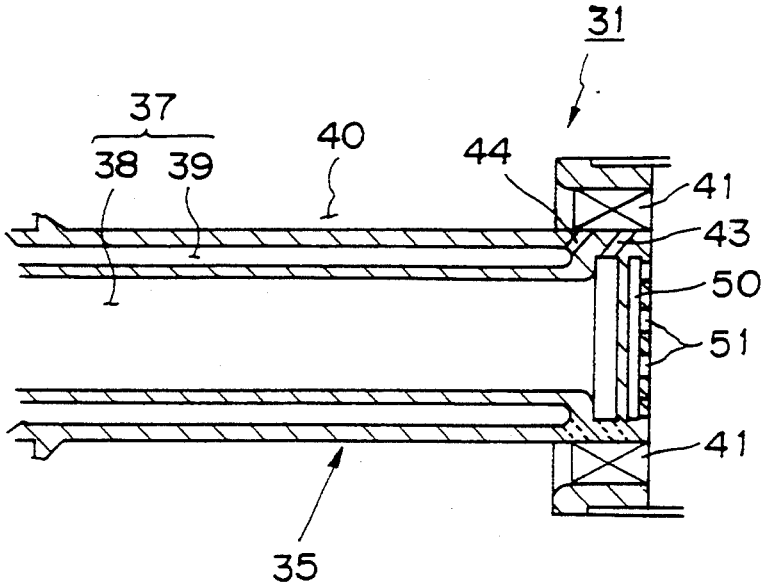
FIG. 3 is a sectional view, in an enlarged scale, of a leading portion of a pilot diffusion combustion nozzle of a pilot fuel nozzle of FIG. 2 serving as a first-stage fuel nozzle included in the gas turbine combustor according to the present invention.

In the nozzle leading portion of the pilot diffusion combustion nozzle 35 of the pilot fuel nozzle 31, a cooling air header 50 is formed as shown in FIG. 3. A plurality of impinging apertures 51 are formed from the cooling air header 50 into the combustor liner 20 to cool the end surface of the pilot diffusion combustion nozzle 35 facing the liner. The air passage portion 40 of the pilot diffusion combustion nozzle 35 is connected to the cooling air header 50 through an air supply hole, not shown, extending to bypass the first and second pilot diffusion fuel injection ports 43 and 44.

The air passage portions 40 and 45 formed in the pilot fuel nozzle 31 are communicated with the air passage 24 through communication ports so that compressed air discharged from the compressor is able to escape to each of the air passage portions 40 and 45 through the communication ports.

On the other hand, a plurality of pre-mixture ducts or pre-mixture pipes 55 forming a pre-mixing means are disposed on the outer surface of the combustor liner 20 to face the main fuel nozzle 33 so that the second-stage fuel supply means 32 is formed. The main fuel nozzle 33 serving as the second-stage fuel nozzle faces the inlet port formed in the pre-mixture duct 55 so that the main fuel C injected through the main fuel nozzle 33 and compressed air d supplied through the air passage 24 are uniformly mixed with each other in the pre-mixture duct 55, followed by injecting the mixed gas into the second-stage combustion region 27 through the duct outlet port. A plurality of fuel injection ports 56 are, in the lengthwise direction of the pre-mixture duct 55, opened at the duct outlet port.

The operation of the gas turbine combustor 15 of the structure described above will be described hereunder.

The operation of the gas turbine combustor 15 is controlled so as to correspond to the operation of the gas turbine 17. From a moment the gas turbine 17 is ignited to a moment the gas turbine load is 0%, the first pilot diffusion fuel a1 is supplied to only the first pilot diffusion fuel passage portion 38 of the pilot fuel nozzle 31 serving as the first-stage fuel nozzle.

A relatively large quantity of first pilot diffusion fuel a1 is injected into the first pilot diffusion fuel passage portion through the first pilot diffusion fuel injection port 43 having a relatively large area of opening. The injected first pilot diffusion fuel a1 reacts with combustion air injected through the pilot diffusion combustion swirler 41 and is stably burnt in the first-stage combustion region 26.

Figure 4:
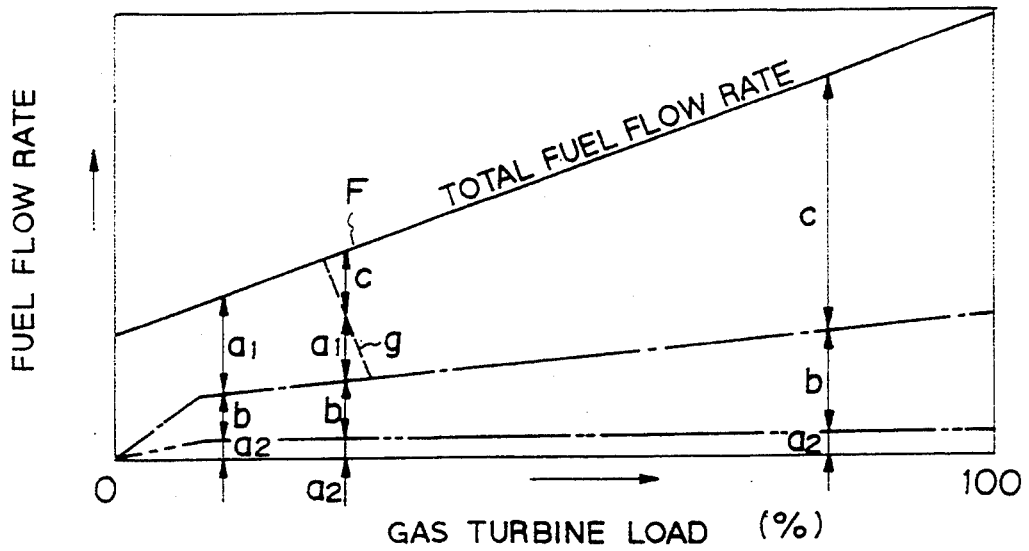
FIG. 4 is a graph showing the relationship (fuel distribution) between each fuel flow rate and gas turbine load of the gas turbine combustor according to the present invention.

As the gas turbine load is raised from 0% load, the total, i.e. overall, flow rate of fuel is increased as shown in FIG. 4. Therefore, the second pilot diffusion fuel a2 and the pilot pre-mixed fuel b are injected in addition to the first pilot diffusion fuel a1. The second pilot diffusion fuel a2 serves as a stable flame source when very-low NOx combustion operation is performed in the heavy turbine load operation region, and therefore it is always injected by several % of the overall fuel rate of the fuel expressed by continuous line F over the entire operation region of the gas turbine 17.

On the other hand, the fuel flow rate of the pilot pre-mixed fuel b is determined to maintain the fuel-air ratio, which is the ratio of the fuel and air, at a combustible range on a lean fuel side of the pre-mixed fuel. The remainder of a subtraction of the second pilot diffusion fuel a2 and the pilot pre-mixed fuel b from the total fuel flow rate F is injected as the first pilot diffusion fuel a1.

The pilot pre-mixing nozzle 36 is formed to radially (in the radial direction) project to the annular air passage portion 45 and has a plurality of fuel injection ports in the axial direction of the pilot pre-mixing nozzle 36. Therefore, an extremely uniform lean fuel-premixed gas, fuel, can be obtained in the pre-mixing portion of the pilot pre-mixing nozzle 36. As a result, generation of NOx is substantially prevented even if combustion undergoes in the first-stage combustion region 26 in the combustor liner 20.

By making the diameter of the downstream portion, adjacent to the combustor line inlet port, of the pre-mixture portion of the pilot pre-mixing nozzle 36, smaller than that of the upstream portion of the same, the flow velocity of the pre-mixed gas is increased to prevent backfire. By determining the swirling angle of the pilot pre-mixture combustion swirler 46 to be an adequate value, for example, 30°, the pilot pre-mixed fuel b injected into the combustor liner 20 can be allowed to flow as designated by symbol e such that it surrounds flow f of the pilot diffusion fuels a1 and a2 forming a stable flame. Therefore, pre-mixed combustion exhibiting excellent combustion efficiency and stability can be realized.

When the gas turbine load is made to be heavier, the temperature of the combustion gas in the combustion chamber 21 in the combustor liner 20 reaches a temperature at which generation of unburnt gas, such as CO, can substantially be prevented even if the main fuel C for the pre-mixture combustion serving as the second-stage fuel is injected in a large quantity.

At a moment the gas turbine load reaches such value, the main fuel C is injected as designated by broken line g of FIG. 4, and the first pilot diffusion fuel a1 is reduced to the contrary so that its supply is stopped. At this time, the second pilot diffusion fuel a2 is injected by about several %, preferably about 2 to 4% of the overall fuel flow rate, while the pilot pre-mixed fuel b is injected such that the fuel-air ratio is the leanest fuel in the combustible range for the pre-mixed gas fuel. Further, the main fuel C is injected such that the fuel-air ratio of the pre-mixed main fuel gas C in the pre-mixture duct 55 is the same level as that of the pilot pre-mixed fuel b. The main fuel C is set so as to be injected by about 70 to 80% of the overall fuel flow rate F.

Since the gas turbine combustor 15 has the pilot diffusion combustion swirler 41 disposed in the air passage portion 40 of the pilot diffusion combustion nozzle 35 of the pilot fuel nozzle 31 and the passage area of the swirler 41 can be designed to make the air quantity suitable for the several % of the overall fuel flow rate F, an extremely stable circulating flow f can be formed in the first-stage combustion region 26 even if the operation is performed with a very little quantity of the second pilot diffusion fuel a2. Therefore, dying of fire or the like can be substantially prevented and the stable combustion can be hence maintained.

Since the second pilot diffusion fuel injection port 44 is formed independently from the first pilot diffusion fuel injection port 43, the fuel difference pressure in front of and in the rear of the fuel injection port can be designed to be a necessary and sufficient value. Therefore, no combustion vibration takes place, thus being advantageous. Since the pilot pre-mixing nozzle 36 has a structure in which the pre-mixed fuel circulating flow e surrounds the pilot diffusion fuel circulating flow f as described above, the satisfactorily stable combustion can be achieved even with lean pre-mixed pilot fuel gas c. Furthermore, generation of NOx is substantially suppressed.

In addition, the pre-mixed gas of main fuel C is injected in a direction of the liner axis center from the pre-mixture duct 55 and into the second-stage combustion region 27 immediately downstream side of the first-stage combustion region 26 which is a stable flame source for burning the second pilot diffusion fuel a2 and pilot pre-mixed fuel b, thus achieving the stable combustion with high efficiency. The combustion of the main pre-mixed fuel C does not substantially generate NOx. As a result, NOx is generated due to the diffusion combustion which is several % of the overall fuel flow rate F. Therefore, the gas turbine combustor 15 can be operated as a whole with very low NOx generated in a state where the generation of NOx is significantly prevented.

In a period from the gas turbine load immediately after the main fuel C has been injected to the 100% turbine load, the temperature of the combustion gas at the outlet port of the gas turbine combustor 15 can be maintained at a substantially constant level. That is, the ratio of the total fuel F and the total air quantity is substantially constant, resulting in a stable operation. Therefore, a safe operation can be performed in which the ratio of the second pilot diffusion fuel a2, the pilot pre-mixed fuel b and the main fuel flow rate C with respect to the total fuel can substantially be maintained at a constant ratio as shown in FIG. 4. Thus, significant reduction of NOx can be realized in a wide gas turbine load region.

Figure 5:
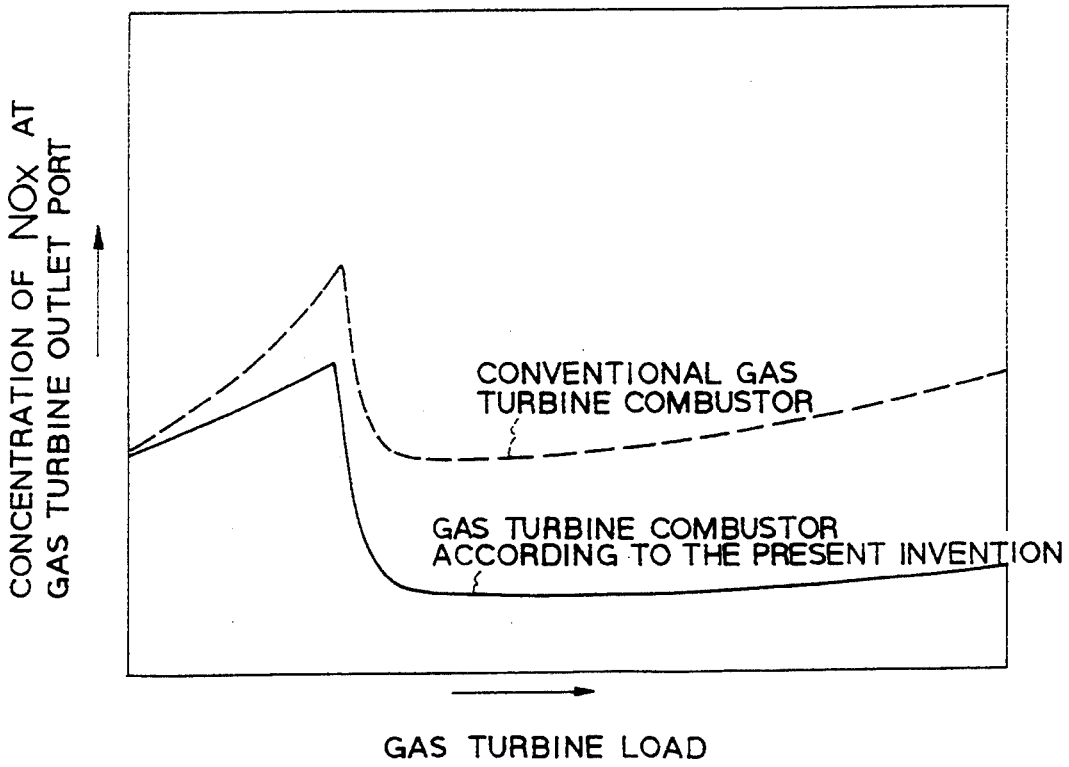
FIG. 5 is a graph showing concentration of NOx with respect to the turbine load of the gas turbine combustor according to the present invention in comparison with a concentration of NOx based on a conventional gas turbine combustor.
Figure 6:
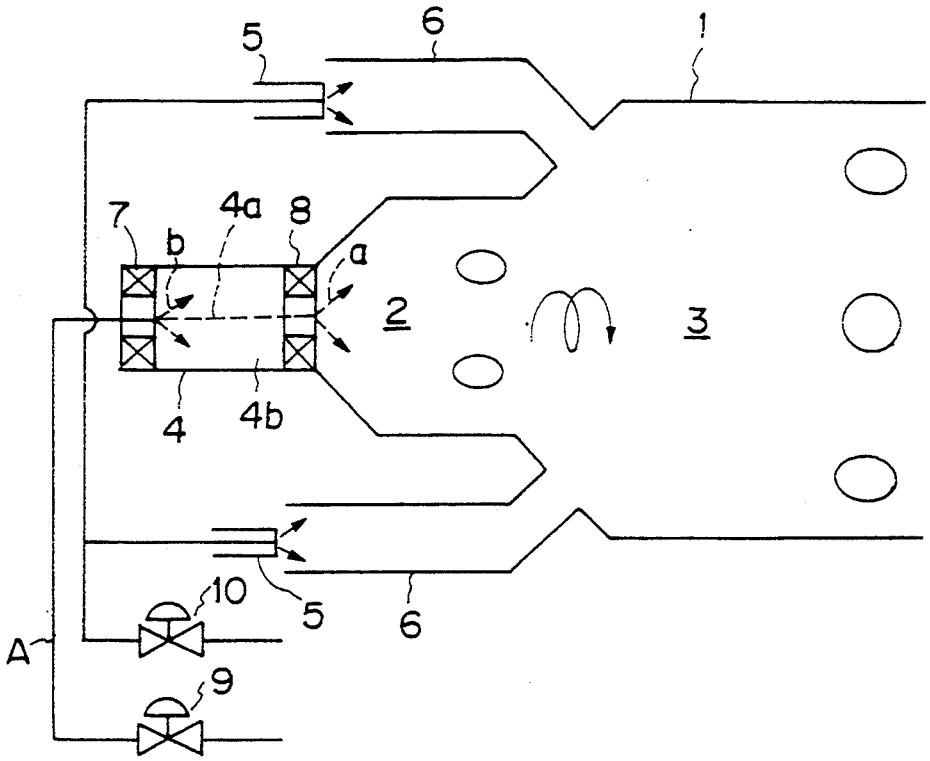
FIG. 6 PRIOR ART
FIG. 6 is a diagram showing one example showing a structure of a conventional low-NOx gas turbine combustor.
Figure 7:
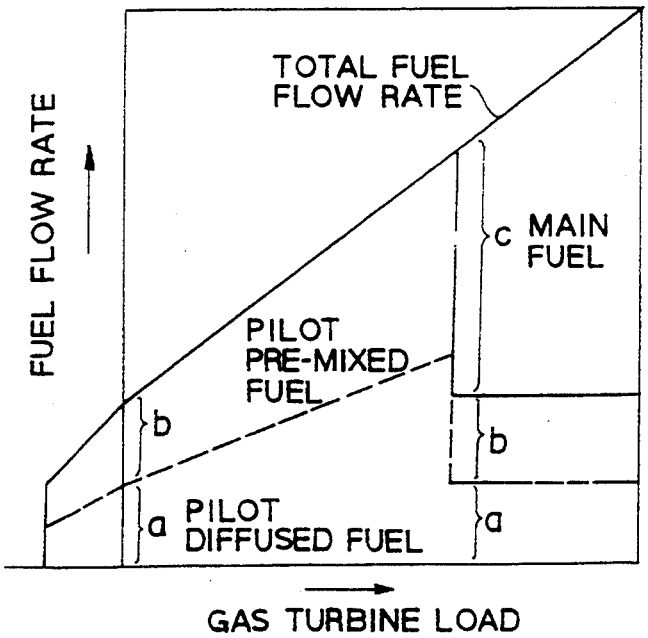
FIG. 7 PRIOR ART
FIG. 7 is a graph showing distribution of each fuel in the gas turbine combustor shown in FIG. 6.
Figure 8:
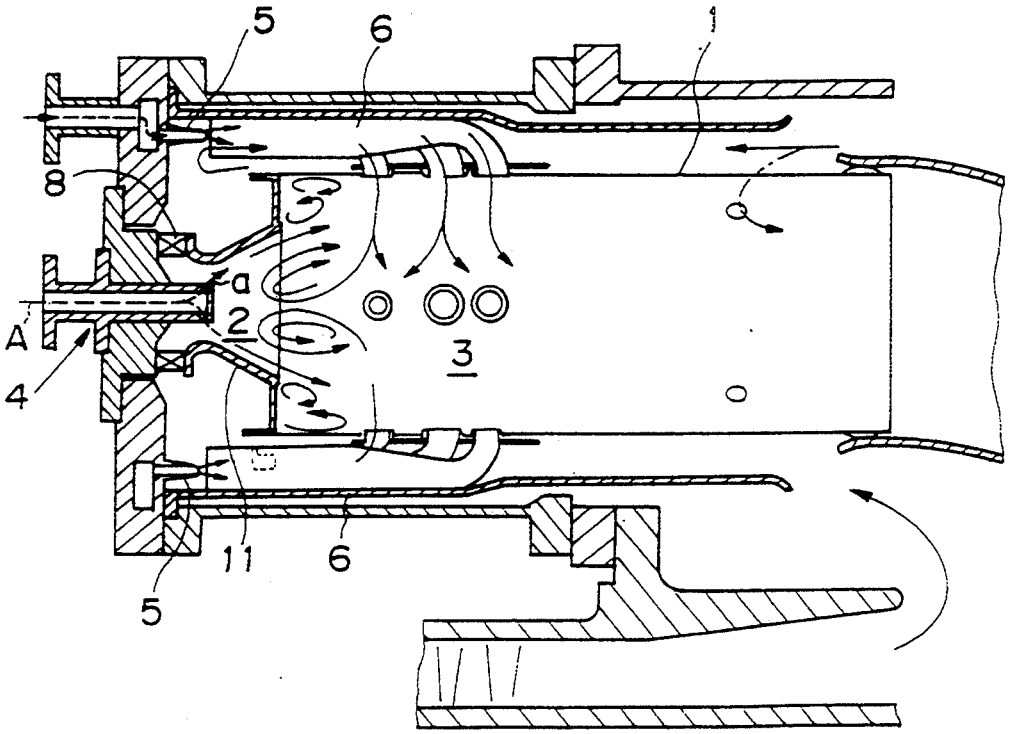
FIG. 8 PRIOR ART
FIG. 8 is a longitudinal sectional view showing another example of the structure of the conventional low-NOx gas turbine combustor.
Figure 9:
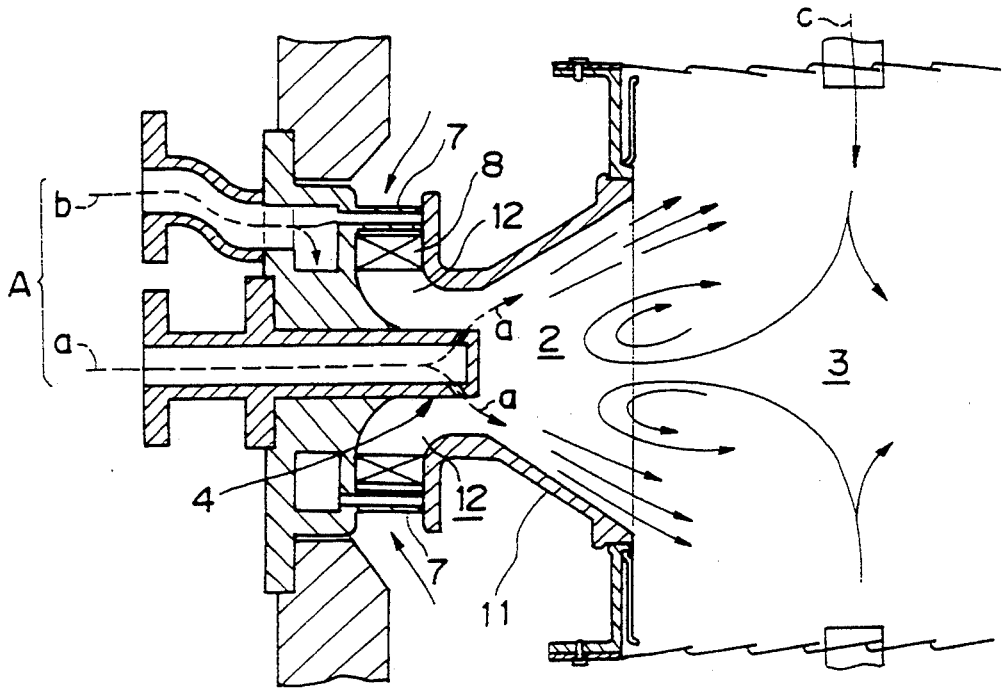
FIG. 9 PRIOR ART
FIG. 9 is a diagram showing an example of a modified structure of the conventional gas turbine combustor shown in FIG. 8.
Figure 10:
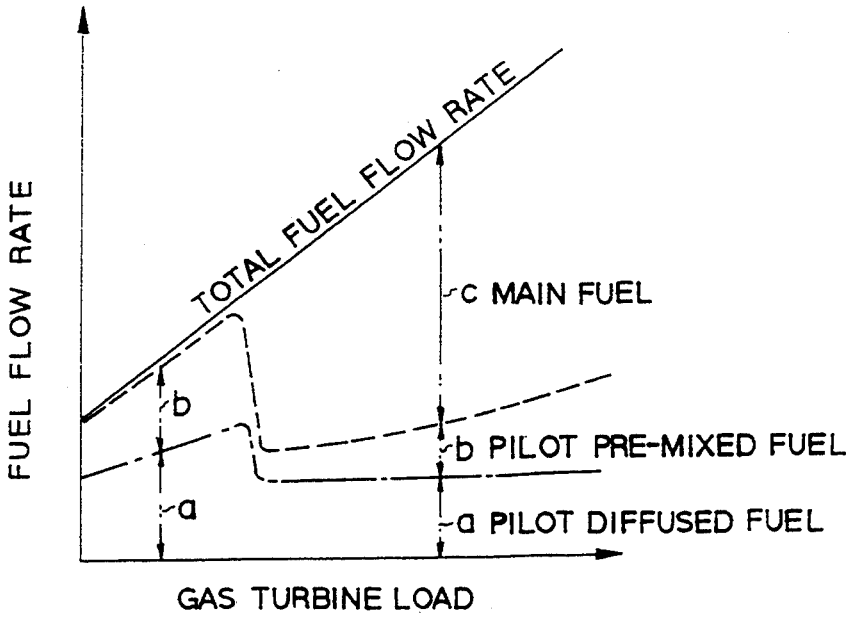
FIG. 10 PRIOR ART
FIG. 10 is graph showing distribution of each fuel in the gas turbine combustor shown in FIG. 9.

FIG. 5 shows experiment data obtained by subjecting, to a comparison, the characteristics of NOx generated in the operation of the gas turbine combustor 15 of the present embodiment and the characteristics of NOx from the conventional low NOx gas turbine combustor. As can be understood from the data, the gas turbine combustor 15 of the present invention is able to reduce NOx value to $\frac{1}{2}$ to $\frac{1}{3}$ as compared with the conventional low NOx gas turbine combustor. In the gas turbine combustor 15 of the present invention, when the NOx value has peak value h, for example, when the turbine load is 20% to more than 20% by several %, the injection of the pre-mixed main fuel C is commenced. When the gas turbine load is about 30%, the NOx value becomes a minimum value. At this time, the supply of the first pilot diffusion fuel a1 is stopped.

In the gas turbine combustor according to the present invention, an example of the basic structure having the most improved combustion performance has been described in the embodiment. However, various modifications thereof may be considered.

For example, the positions of the first and second pilot diffusion fuel passage portions may be exchanged, and the pilot pre-mixed fuel nozzle may be disposed upstream from the pilot pre-mixture combustion swirler. Furthermore, it may be not necessary for the pilot pre-mixing fuel nozzle to be formed into a projection. The pilot pre-mixed fuel may be injected into the air passage portion from the inner wall portion or the outer wall portion of the pilot pre-mixture combustion air passage portion or the like. Still furthermore, the pilot diffusion fuel passage portion may be integrally formed into one fuel passage in place of the division of the same into the first fuel passage and the second fuel passage.

As described above, according to the gas turbine combustor of the present invention, the fuel is injected into the first-stage combustion region in the combustor liner by the first-stage fuel supply means. On the other hand, fuel is, by the second-stage fuel supply means, injected in a lean fuel state into the second-stage combustion region to be burnt in the combustor liner. On the other hand, the first-stage fuel supply means has the first-stage fuel nozzle formed by combining the diffusion combustion nozzle and the pre-mixture combustion nozzle. The diffusion combustion nozzle realizes diffusion combustion exhibiting the excellent combustion efficiency and the combustion stability. In order to substantially prevent generation of NOx in the pre-mixture combustion nozzle, the diameter of the downstream portion of the pre-mixing portion for previously mixing in a lean fuel state is made smaller than that of the upstream portion of the same so that the stable combustion of the pre-mixed gas and the prevention of misfire are realized. Thus, the stable combustion can be maintained in a state where the ratio of the diffusion combustion which generates NOx considerably is very low. As a result, NOx can be significantly be reduced and the ratio of the diffusion combustion can be lowered while maintaining the stable combustion.

The diffusion combustion nozzle of the first-stage fuel nozzle provided for the gas turbine combustor has the fuel passage portion in the central portion thereof and the air passage portion formed concentrically around this passage portion and allowing an air flow rate adaptable to the diffused fuel which is several % of the total fuel flow rate to flow. The swirler for swirling air and the fuel injection port are provided on the inlet port side of the combustor liner of the air passage portion. As a result, the diffusion combustion exhibiting the excellent combustion efficiency and the combustion stability can be realized.

In the foregoing state, the diffusion combustion nozzle has the fuel passage portion individually sectioned into the first fuel passage portion and the second fuel passage portion. Therefore, the first fuel passage portion can be formed into a fuel passage for allowing a relatively large quantity of diffusion combustion fuel to flow at the light turbine load, while the second fuel passage portion can be formed into a fuel passage for allowing the diffusion combustion fuel which is several % of the total fuel flow rate to flow at the low NOx operation under heavy gas turbine load. By forming the fuel injection port having an opened area adaptable to each fuel flow rate in the downstream portion of each fuel passage portion, further stable combustion can be achieved and the lowering of NOx can be realized. Since the air passage portion of the diffusion combustion nozzle may have a passage area corresponding to the diffused fuel which is several % of the total fuel flow rate, the size thereof can be reduced. The small-size diffusion combustion nozzle assuredly enables the stable combustion to be achieved.

The pre-mixture combustion nozzle of the first-stage fuel supply means has the fuel injection portion formed into a radial direction projection shape with respect to the annular air passage portion. Further, a plurality of fuel injection ports are formed at the axial directional positions of the projection to inject the fuel in a dispersed manner. As a result, further uniform mixture can be achieved and lowering of NOx can thus be realized.

What is claimed is:

1. A gas turbine combustor comprising:

a cylindrical outer casing having one end opening closed by a header plate;

a combustor liner disposed inside the outer casing and provided with an inner combustor chamber which is divided into a first-stage combustion region on a side of the header plate and a second-stage combustion region formed on a downstream side of the first-stage combustion region; and a fuel supplying means including a first-stage fuel supply means mounted to the header plate for injecting a first-stage fuel to the first-stage combustion region and a second-stage fuel supply means mounted to the header plate for injecting a second-stage fuel previously mixed in a lean fuel state, said first-stage fuel supply means comprising a first-stage fuel nozzle assembly which supplies the first-stage fuel and which is formed by combining a diffusion combustion nozzle acting as a pilot combustion nozzle and a pre-mixture combustion nozzle disposed independently from the diffusion combustion nozzle, said diffusion combustion nozzle being of a double cylindrical structure having a fuel passage portion extending in an axial direction thereof and an air passage portion formed in an outer peripheral portion of said fuel passage portion between the diffusion combustion nozzle and the pre-mixture combustion nozzle, said air passage portion being provided, on the first-stage combustion region side, with a first swirler means for imparting a swirling motion to air, and a fuel injection port for injecting fuel from the fuel passage portion, said fuel passage portion formed in said diffusion combustion nozzle being provided with a first fuel passage portion at a central portion thereof capable of supplying the first-stage fuel and a second fuel passage portion capable of supplying the first-stage fuel in a quantity different from the supply quantity through the first fuel passage portion, said first and second fuel passage portions being formed independently from each other, said pre-mixture combustion nozzle being disposed so as to concentrically surround the diffusion combustion nozzle for supplying the pre-mixture gas of air and fuel to the first-stage combustion region, said pre-mixture combustion nozzle having a double cylindrical structure having an annular fuel passage and an annular air passage surrounding the annular fuel passage, said annular air passage having an inlet side portion to which a second swirler means is disposed for causing swirling motion to the air, and a plurality of fuel injection nozzles being disposed in the annular air passage for forming an air and fuel pre-mixture region, and said second fuel supply means being provided with a plurality of fuel nozzles and a premixing portion for premixing air and fuel, and supplying the pre-mixture air and fuel to the second combustion region.

2. A gas turbine combustor according to claim 1, wherein the second fuel passage portion supplies the first-stage fuel in a quantity smaller than the supply quantity through the first fuel passage portion.

3. A gas turbine combustor according to claim 1, wherein said first fuel passage portion is provided with a fuel injection port at an end portion thereof on the first-stage combustion region for passing a quantity of the fuel which is 2–10% of a total flow quantity at a gas turbine rated load operation period, and wherein said second fuel passage portion is provided with a fuel injection port at an end portion thereof on the first-stage combustion region for passing a quantity of the fuel which is approximately equal to 50% of the total flow quantity at the gas turbine rated load operation period.

4. A gas turbine combustor according to claim 1, wherein said plurality of fuel injection nozzles being formed in the annular air passage and disposed on an upstream side of the second swirler means.

5. A gas turbine combustor according to claim 1, wherein said plurality of fuel injection nozzles being formed in the annular air passage and disposed on a downstream side of the second swirler means.

6. A gas turbine combustor according to claim 1, wherein said plurality of fuel nozzles being formed in the annular air passage and extending in the annular air passage in a radial direction thereof, and each of said fuel nozzles is provided with a plurality of fuel injection ports in a radial direction thereof so as to inject the fuel into the annular air passage.

7. A gas turbine combustor according to claim 1, wherein said premixing portion of the second fuel supply means comprises a plurality of premixing ducts disposed around the combustor liner, and each of said fuel nozzles of the second fuel supply means is provided with at least one fuel injection port at a front end thereof so as to direct the fuel into an inlet port of the premixing duct.

8. A gas turbine combustor according to claim 1, wherein an air header is formed at a downstream end portion of the diffusion combustion nozzle as the pilot combustion nozzle, said air header being provided with a plurality of impinging apertures opened to the first-stage combustion region of the combustor liner.

9. A gas turbine combustor according to claim 1, wherein said premixing portion has a diameter in a downstream portion thereof smaller than that of an upstream portion thereof so as to form a pre-mixed flow into a contraction flow.

* * * * *